US008104916B2

(12) United States Patent
Liu

(10) Patent No.: US 8,104,916 B2
(45) Date of Patent: Jan. 31, 2012

(54) FLASHLIGHT

(76) Inventor: Yun-Zhao Liu, Zhongshan (CN)

( * ) Notice: Subject to any disclaimer, the term of this patent is extended or adjusted under 35 U.S.C. 154(b) by 300 days.

(21) Appl. No.: 12/588,221

(22) Filed: Oct. 8, 2009

(65) Prior Publication Data

US 2011/0085324 A1 Apr. 14, 2011

(51) Int. Cl.
*F21L 4/00* (2006.01)

(52) U.S. Cl. ..... 362/202; 362/373; 362/190; 362/218; 362/345

(58) Field of Classification Search ..... None
See application file for complete search history.

(56) References Cited

U.S. PATENT DOCUMENTS 6,966,667 B2 * 11/2005 Li ..... 362/102

* cited by examiner

*Primary Examiner* — Sharon Payne
(74) *Attorney, Agent, or Firm* — Rosenberg, Klein & Lee

(57) ABSTRACT

This invention provides a flashlight in which locating slots for constraining and fixing conductive strips are provided in a plastic housing. The conductive strips are connected with a conductive heat dissipation element of a light source body and a conductive seat at the tail portion of the plastic housing, and are turned on by the conductive seat and a smart controller such that variation of the light emitted from the light source body is controlled by the smart controller. In addition, the conductive heat dissipation element of the light source body is assembled with the front cover having heat dissipation effect so that the heat dissipation of the light source body is facilitated and hence the lifetime of the light source body is extended.

2 Claims, 6 Drawing Sheets

FLASHLIGHT

BACKGROUND OF THE INVENTION

1. Field of the Invention

This invention relates to a flashlight, especially to a flashlight having its housing being made of plastic material, which can meet the market demand by the diversified and beautiful housing assembled with a plurality of conductive or illuminative members. In addition, the conductive heat dissipation element of the light source body is assembled with the front cover having heat dissipation effect so that the heat dissipation of the light source body is facilitated and hence the lifetime of the light source is extended.

2. Brief Description of Prior Art

In daily life, illumination is often required in some cases when, for example, suddenly entering a dark room and unable to find light switch at once, or sudden electric power cut in the interior at night, or unlocking the door at night, or searching something in the dark. In these cases, immediate light is helpful.

Usually, people seldom have the habit to take flashlight with them, as it maybe heavy or the chance of using flashlight is unforeseen. Thus, most people think of flashlight when in the case of need, and often catch themselves in predicament as there is no flashlight available on hand. On the other hand, even there is a portable compact flashlight, most of the material to make flashlight has heavy-weight which makes it inconvenient to carry. In addition, processing of metal is troublesome and metal is more expensive so that manufacturing cost is high.

In view of the above facts, the inventor of the present invention, having in pursuit of excellence as spirit and philosophy, provides a new flashlight according to the improvement conducted on structure and defects of the prior art, based on his professional knowledge and abundant experience in the art, after uncountable try and error process, so as to attain the goal of obtaining better implementation effectiveness and value.

SUMMARY OF THE INVENTION

The object and effectiveness of the flashlight of the present invention can be realized by the following technology:

A flashlight, in which locating slots for constraining and fixing conductive strips are provided in a plastic housing, the conductive strips being connected with a conductive heat dissipation element assembled with a light source and a conductive seat at the tail portion of the plastic housing, and being turned on by the conductive seat and a smart controller such that variation of the light emitted from the light source body is controlled by the smart controller.

Further, the locating slots of the flashlight of this invention are formed as dovetail shape slots for constraining and fixing the conductive strips. The conductive strips are thus constrained by the dovetail shape slots so as to be prevented from stripping off during the assembly and disassembly of the flashlight components and battery.

In the flashlight of this invention, the conductive heat dissipation element of the light source body is assembled with the front cover having heat dissipation effect so that the heat dissipation of the light source is facilitated and hence the lifetime of the light source is extended.

DETAILED DESCRIPTION OF THE PREFERRED EMBODIMENTS

The objects, the technical contents and the expected effectiveness of the present invention will become more apparent from the detailed description of the preferred embodiment in conjunction with the accompanying drawings.

Figure 1:
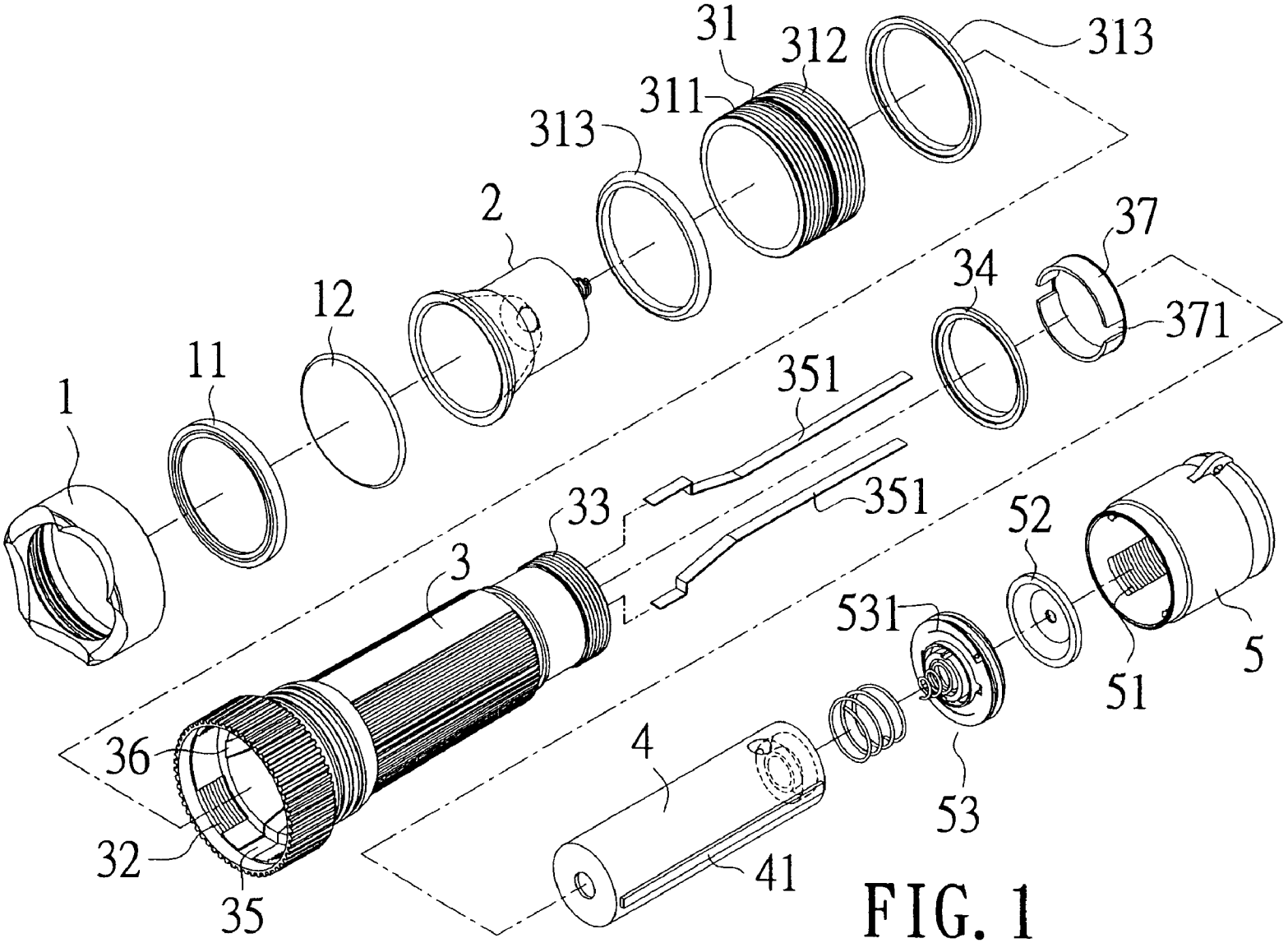
FIG. 1 is a perspective exploded schematic view showing the flashlight of the present invention.
Figure 2:
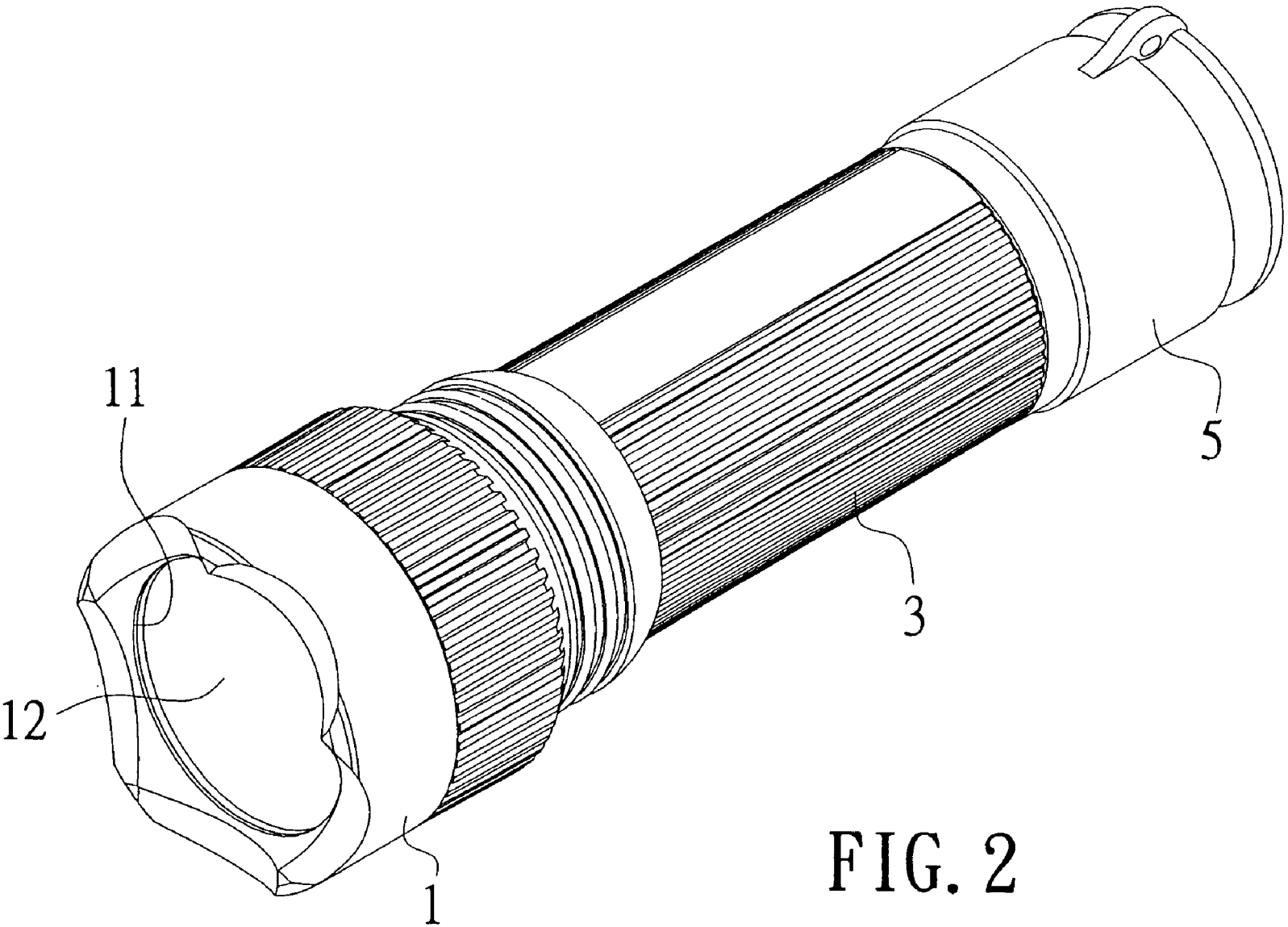
FIG. 2 is an assembled schematic view showing the flashlight of the present invention.
Figure 3:
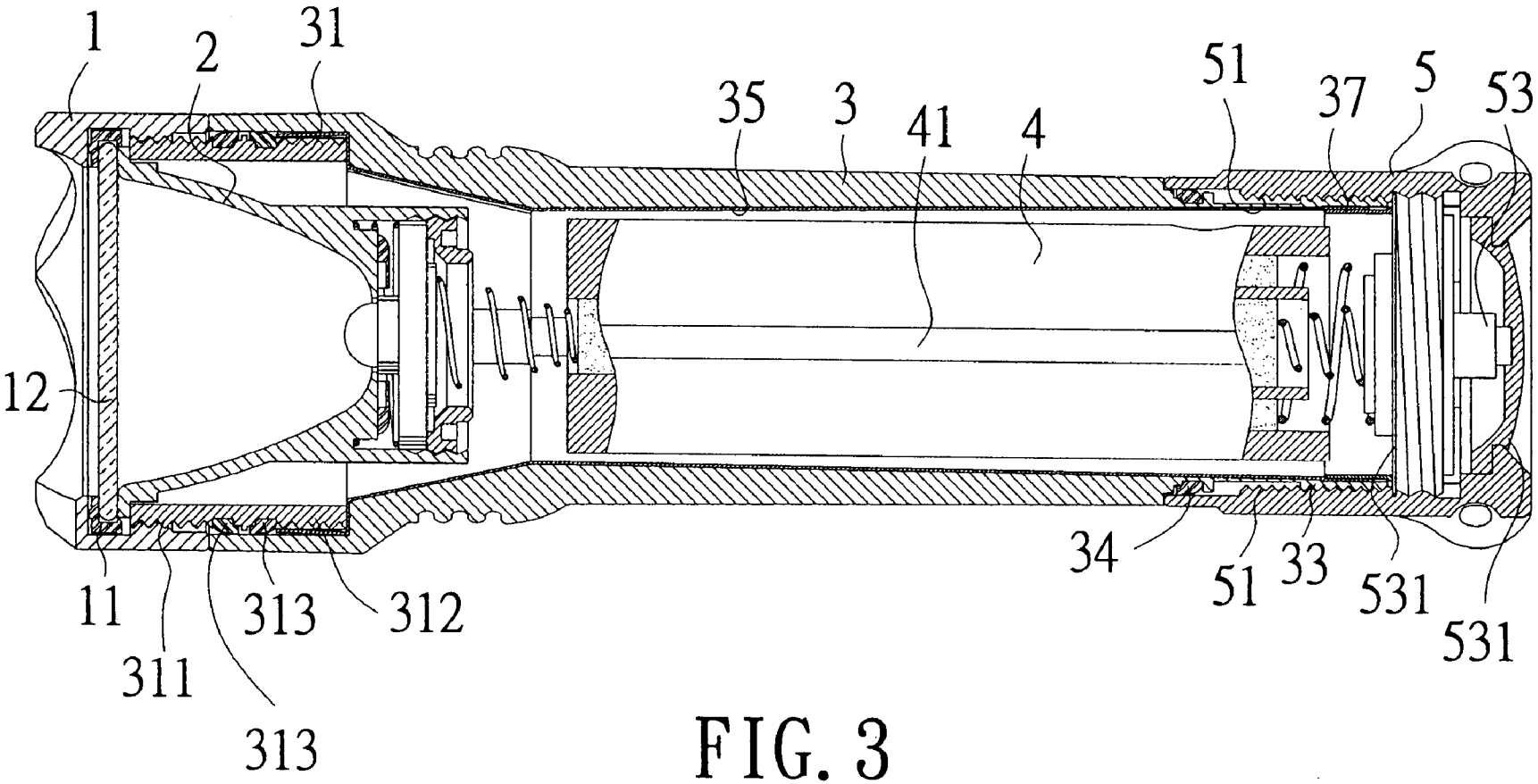
FIG. 3 is a sectional schematic view showing the flashlight of the present invention.
Figure 4:
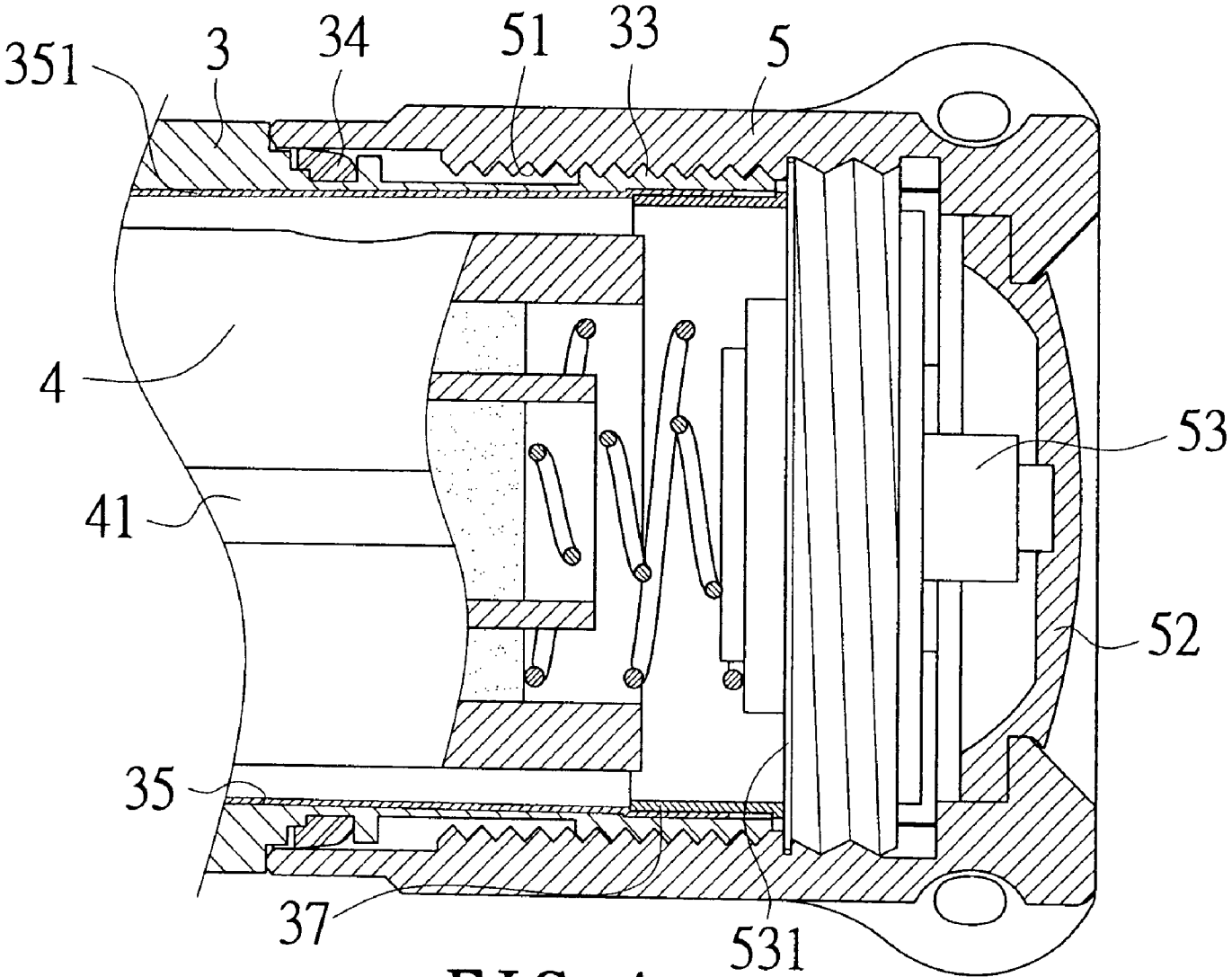
FIG. 4 is a partial sectional enlarged schematic view showing the flashlight of the present invention.
Figure 5:
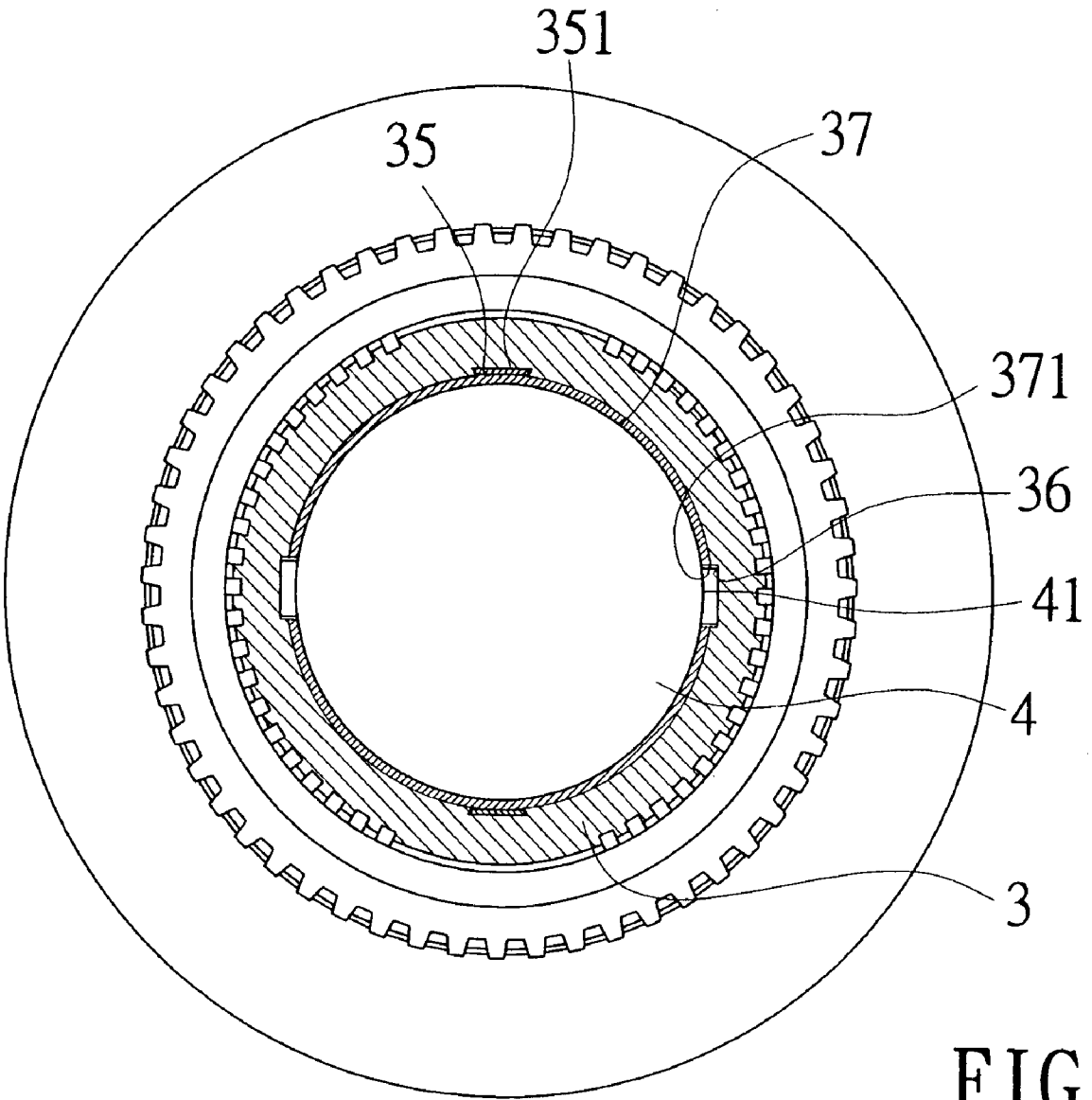
FIG. 5 is another sectional schematic view showing the flashlight of the present invention.
Figure 6:
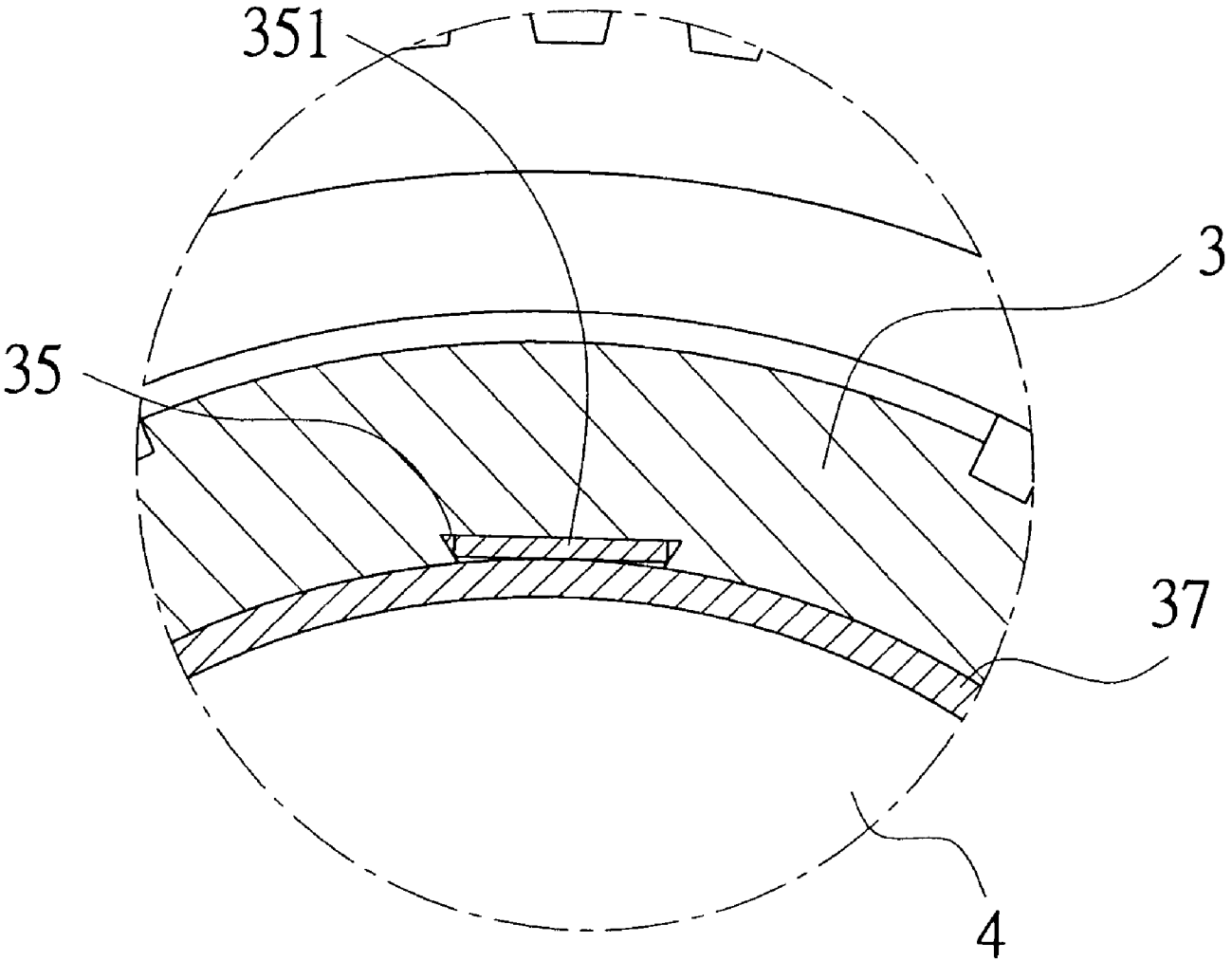
FIG. 6 is another partial sectional enlarged schematic view showing the flashlight of the present invention.

FIGS. 1 to 3 are respectively perspective exploded, assembled and sectional schematic views showing the flashlight of the present invention, which essentially comprises:

a heat dissipative front cover (1), being a front cover body having heat dissipation function, which is provided with a waterproof rubber ring (11) and a light transmissive lens (12) inserted in its interior;

a light source body (2), being a light source unit for producing light, which is provided in the interior of the heat dissipative front cover (1);

a conductive heat dissipative element (31) which is provided with a front and a rear thread segments (311), (312) respectively on the front and rear ends of the outer wall, and waterproof gaskets (313) provided at neighbor sides of the front and the rear thread segments (311), (312), said front thread segment (311) being in thread engagement with the heat dissipative front cover (1) so as to abut against the light source body (2);

a plastic housing (3), having a inner thread segment (32) provided at its front end which is threadly engaged with the rear thread segment (312) of the conductive heat dissipative element (31); and a outer thread segment (33) provided at its tail end and a waterproof gasket (34) provided at neighbor side; and two opposite locating slots (35) and two opposite positioning slots (36) provided at the inner wall of the housing, the locating slots (35) being for constraining and fixing the conductive strips (351) one ends of which are contacted with the conductive heat dissipative element (31), while the positioning slots (36) being used for the guiding and positioning of battery (4) having slide bars;

a conductive seat (37), inserted into the tail end of the plastic housing (3) to cover and to contact the conductive strips (351), which has guide slots (371) provided at the places corresponding to the positioning slots (36) of the plastic housing (3) for the guide-in of battery (4);

a plastic tail cover (5), having a inner thread segment (51) which is in thread engagement with the outer thread segment (33) provided at tail end of the plastic housing (3), a waterproof cap (52) and a smart controller (53) being provide in the interior of the tail cover, a conductive ring strip (531) for contact with the conductive seat (37) being provided on the smart controller (53).

Referring to FIGS. 1 to 6, during assembly and usage, the waterproof rubber ring (11) and the light transmissive lens (12) are inserted into the interior of the heat dissipative front cover (1), then the light source body (2) is inserted into the same. In turn, the front thread segment (311) of the conductive heat dissipative element (31) is threadly engaged with the heat dissipative front cover (1) so as to abut tightly the light source body (2) and the waterproof gasket (313) provided at neighbor side is abutted around the periphery of the heat dissipative front cover (1). In turn, conductive strips (351) are respectively disposed into the two locating slots (35) of the plastic housing (3) which constrain and fix the conductive strips (351) by dovetail slot shape design. Then, the rear thread segment (312) of the conductive heat dissipative element (31) is threadly engaged with the inner thread segment (32) of the plastic housing (3), and one ends of the conductive strips (351) are contacted with the conductive heat dissipative element (31). Next, the conductive seat (37) is inserted into the tail end of the plastic housing (3) so as to cover and to contact with the conductive strips (351), and the battery (4) having slide bars (41) on both sides are introduced into the guide slots (371) corresponding to the positioning slots (36) so that the upper end of the battery (4) is contacted with the light source body (2). In turn, a waterproof cap (52) and a smart controller (53) are disposed in the plastic tail cover (5) in this order, and the inner thread segment (51) is threadly engaged with the outer thread segment (33) on the tail end of the plastic housing (3) so that the tail end of the battery (4) is contacted with the smart controller (53). The conductive seat (37) and the conductive ring strip (531) on the smart controller (53) form a closed loop.

When the two conductive strips (351) are connected with the conductive heat dissipative element (31) of the light source body (2) and the conductive seat (37) at the tail portion of the plastic housing (3), and furthermore the conductive seat (37) is electrically connected with the conductive ring strip (531) of the smart controller (53), the variation of the light emitted from the light source body (2) can be controlled by the smart controller (53).

The abovementioned embodiment and drawings are not intended to restrict the structural aspect or the dimensions of the present invention. Appropriate variations and modifications made by the person having ordinary knowledge in the art without departing from the spirit and scope of the present invention are still regarded to be within the scope of the present invention.

Based on the foregoing, the flashlight of the present invention indeed has the following advantages, when comparing with prior art:

1. In the flashlight of this invention, the two conductive strips are connected with the conductive heat dissipative element of the light source body and the conductive seat at the tail portion of the plastic housing, and furthermore the conductive seat is electrically connected with the conductive ring strip of the smart controller, variation of the light emitted from the light source body can be controlled by the smart controller.

2. The same as above, the two conductive strips will not be stripped-off by the dovetail slot shape design of the locating slots during the assembly and disassembly of the flashlight components and the battery. Therefore, the effect of constraining and fixing can be achieved.

3. In the flashlight of the present invention, the conductive heat dissipative element having assembled with a light source body is assembled with the front cover having heat dissipation effect so as to facilitate heat dissipation of the light source body effectively. Therefore, the lifetime of the light source body can be extended.

4. In the flashlight of the present invention, the battery having slide bars can be guided into positions by the design of the positioning slots of the plastic housing and the guide groove of the conductive seat such that the electrode of the battery can be mounted in sole direction. Therefore, there is no problem of wrong mounting of battery.

5. The flashlight of the present invention can reduce its weight by using plastic material in its housing and tail cover, and the usage of plastic material enables diversified styling for flashlight. Therefore, a creation having practicality is realized.

Summing up above, the embodiment of the present invention is surely able to reach expected effectiveness in application, and the specific structure disclosed herein is not only unprecedented in the same category of product but also not open to the public before application.

What is claimed is:

1. A flashlight, comprising:

a heat dissipative front cover, being a front cover body having heat dissipation function, which is provided with a waterproof rubber ring and a light transmissive lens inserted in its interior;

a light source body, being a light source unit for producing light, which is provided in the interior of the heat dissipative front cover;

a conductive heat dissipative element which is provided with a front and a rear thread segments respectively on the front and rear ends of the outer wall, and waterproof gaskets provided at neighbor sides of the front and the rear thread segments, said front thread segment being in thread engagement with the heat dissipative front cover so that the light source body can be clamped and fixed therebetween;

a plastic housing, having a inner thread segment provided at its front end which is in thread engagement with the rear thread segment of the conductive heat dissipative element; and a outer thread segment provided at its tail end and a waterproof gasket provided at neighbor side; and two opposite locating slots and two opposite positioning slots provided at the inner wall of the housing, the locating slots being for locating and fixing the conductive strips one ends of which are contacted with the conductive heat dissipative element, while the positioning slots being used for the guiding and positioning of battery having slide bars;

a conductive seat, inserted into the tail end of the plastic housing to cover and to contact the conductive strips, which has guide slots provided at the places corresponding to the positioning slots of the plastic housing for the guide-in of battery;

a plastic tail cover, having a inner thread segment which is in thread engagement with a outer thread segment provided at tail end of the plastic housing, a waterproof cap and a smart controller being provided in the interior of the tail cover, a conductive ring strip for contact with the conductive seat being provided on the smart controller.

2. A flashlight as claimed in claim 1, wherein said locating slots in the interior of the plastic housing are further formed as dovetail shape slots for constraining and fixing said conductive strips.

* * * * *